US012509962B2

(12) United States Patent
Horn et al.

(10) Patent No.: US 12,509,962 B2
(45) Date of Patent: Dec. 30, 2025

(54) DOWNHOLE SEALING APPARATUS

(71) Applicant: DeltaTek Oil Tools Limited, Aberdeen (GB)

(72) Inventors: Tristam Paul Horn, Westhill (GB); Stephen Edmund Bruce, Blairgowrie (GB); David Michael Shand, Banchory (GB); Gregor McLellan, Aberdeen (GB)

(73) Assignee: EXPRO NORTH SEA LIMITED, Dyce (GB)

( * ) Notice: Subject to any disclaimer, the term of this patent is extended or adjusted under 35 U.S.C. 154(b) by 0 days.

(21) Appl. No.: 18/381,971

(22) Filed: Oct. 19, 2023

(65) Prior Publication Data

US 2024/0133266 A1 Apr. 25, 2024
US 2024/0229604 A9 Jul. 11, 2024

(30) Foreign Application Priority Data

Oct. 20, 2022 (GB) ..... 2215520

(51) Int. Cl.
*E21B 33/128* (2006.01)
*E21B 34/14* (2006.01)

(52) U.S. Cl.
CPC ..... *E21B 34/142* (2020.05); *E21B 33/1285* (2013.01); *E21B 2200/01* (2020.05)

(58) Field of Classification Search
CPC .... E21B 33/12; E21B 33/1285; E21B 34/142; E21B 2200/01
See application file for complete search history.

(56) References Cited

U.S. PATENT DOCUMENTS 7,647,964 B2 * 1/2010 Akbar ..... E21B 33/138 166/284
9,279,305 B2 * 3/2016 Linklater ..... E21B 47/117
9,765,595 B2 * 9/2017 Themig ..... E21B 43/12
9,835,004 B2 * 12/2017 Keerthivasan ..... E21B 23/08
2004/0163820 A1 * 8/2004 Bishop ..... E21B 34/142 166/373
2011/0061856 A1 * 3/2011 Kellner ..... F16K 27/0245 251/359
2012/0061094 A1 * 3/2012 Soni ..... E21B 34/14 166/373

(Continued)

FOREIGN PATENT DOCUMENTS

CN 113565483 A * 10/2021
GB 2598081 A * 2/2022 ..... E21B 23/04

(Continued)

*Primary Examiner* — Matthew R Buck
(74) *Attorney, Agent, or Firm* — Getz Balich LLC

(57) ABSTRACT

A downhole sealing apparatus for location in a downhole tubular includes a ball and a downhole seat. The ball may comprise a rigid core and a deformable covering. The ball is translatable downhole towards the seat, the ball and the seat having an open first configuration and a sealing second configuration. In the open first configuration the ball and seat are spaced apart such that fluid may flow through the seat. In the sealing second configuration the ball and the seat are in sealing engagement and the ball is deformed to maintain the sealing engagement with the seat in response to a differential pressure acting in a first axial direction and in response to a differential pressure acting in an opposite second axial direction.

20 Claims, 11 Drawing Sheets

(56) References Cited

U.S. PATENT DOCUMENTS

| | | | | |
|---|---|---|---|---|
| 2014/0318816 | A1* | 10/2014 | Hofman | E21B 34/14<br>166/194 |
| 2016/0177656 | A1* | 6/2016 | Streich | E21B 23/0413<br>166/193 |
| 2018/0119509 | A1* | 5/2018 | Hered | E21B 33/12 |

FOREIGN PATENT DOCUMENTS

| | | | | |
|---|---|---|---|---|
| WO | WO-02068793 | A1 * | 9/2002 | E21B 21/003 |
| WO | 2017052510 | A1 | 3/2017 | |
| WO | 2021183379 | A1 | 9/2021 | |

* cited by examiner

DOWNHOLE SEALING APPARATUS

BACKGROUND OF THE INVENTION

1. Technical Field

This disclosure relates to downhole sealing apparatus and methods, and in particular to a seal arrangement including a closure element in the form of a ball.

2. Background Information

In downhole operations, such as the exploration for and extraction of hydrocarbons from subsurface reservoirs, it may be desired to seal or close the through bore of a tubing, for example a tubular support member or pipe. This may be achieved by placing a ball in the tubing at surface, the ball then traveling down through the tubing and landing on a ball seat. The ball may form a seal with the seat, isolating the fluid above the ball from the fluid below the ball and allowing the creation of a pressure differential across the ball. The pressure in the fluid above the ball may be increased to activate or operate a tool or a device.

In the presence of a reverse pressure differential, the ball may lift off the seat. Thus, the ball may be retrieved by reverse circulation of fluid in the tubing, or in other arrangements the ball may be forced through the seat by application of an elevated pressure, and land in a ball catcher.

When it is desired to create a seal or barrier that does not rely on a pressure differential to maintain a sealing member or activating device in place, it has been proposed to provide a sealing dart providing with a latch arrangement for engaging with a seat, for example as described in U.S. Pat. No. 8,899,335.

SUMMARY

According to first aspect of the present disclosure there is provided downhole sealing apparatus comprising a ball and a downhole seat, at least one of the ball and the seat being deformable, the ball being translatable downhole towards the seat, the ball and the seat having an open first configuration and a sealing second configuration, in the open first configuration the ball and seat being spaced apart such that fluid may flow through the seat, and in the sealing second configuration the ball and the seat being in sealing engagement and configured to maintain the sealing engagement in response to a differential pressure acting in a first axial direction and in response to a differential pressure acting in an opposite second axial direction.

According to a second aspect of the disclosure there is provided a downhole sealing method comprising: translating a ball downhole to engage with a seat; and reconfiguring at least one of the ball and the seat whereby the seat cooperates with the ball to provide a bidirectional seal.

The seat may be provided in downhole tubing, such as a drill string, a tool string, a running string, casing, or liner.

The seat may comprise a no-go for the ball, that is the seat prevents downhole translation of the ball beyond the seat. The no-go may prevent translation of the ball through or beyond the seat in response to an elevated differential pressure acting in the first axial direction.

At least one of the ball and the seat may deform or be otherwise reconfigured on the ball engaging the seat such that the ball is engaged with the seat to prevent or restrict movement in the first and second axial directions. The engagement of the ball with the seat may be in response to movement of the ball in the first axial direction. The ball may move in the first axial direction in response to at least one of gravitational forces, entrainment in a moving fluid stream, or a differential pressure acting across the ball. Reconfiguring of the ball or seat may result from translation of the ball relative to the seat, for example the ball translating into a fixed seat. Alternatively, or in addition, reconfiguring of the ball or seat may result from translation of the ball and seat relative to downhole tubing. For example, the seat may be mounted on a profiled portion of downhole tubing, for example tubing having an internal taper, and translation of the seat relative to the tubing may reconfigure the seat, for example the outer diameter described by the seat may be reduced.

The ball and seat may be reconfigured to lock the ball in the seat.

The first axial direction may be downhole, and the second axial direction may be uphole.

The seat may be configured to permit the ball to be translated in the first axial direction into a locking or sealing location within the seat and configured to prevent or restrict movement of the ball in the opposite second axial direction. The seat may comprise a restriction, a taper, directional grips, or teeth. The seat may include a shallow taper or wedge whereby the ball may be urged or pushed through the seat into the locking or sealing location. The resulting engagement between the ball and seat may restrict or prevent movement in the opposite or reverse direction.

The seat may be configured as a no-go and beyond which further translation of the ball in the first axial direction is not possible, at least in response to normal operation conditions, for example the differential pressures which may be safely generated in the tubing above the ball.

The seat may comprise an upstream restriction of a diameter smaller than the diameter of the ball and through which the ball may be translated under application of a differential pressure acting in the first axial direction, and a downstream restriction of a diameter smaller than the diameter of the upstream restriction through which the ball cannot be translated whereby the ball is retained between the restrictions. One or both of the ball and the seat may be subject to deformation as the ball is translated through the upstream restriction. The seat may comprise a first sealing portion at or adjacent the downstream restriction for providing a sealing contact with the retained ball when the ball is subject to differential pressure acting in the first axial direction. The seat may further comprise a second sealing portion providing a sealing contact with the retained ball when the ball is subject to differential pressure acting in the second axial direction.

The ball may include a deformable outer portion and a relatively rigid inner portion. In one example the outer portion may be formed of a plastics or polymeric material and the inner portion may be formed of a relatively rigid and dense material, such as a metal or a ceramic. In other examples a ball may comprise a deformable outer portion and a deformable inner portion or core; the inner and outer portions may be formed of materials having different properties, for example the outer portion may be more easily deformed than the inner portion. The thickness and properties of the deformable outer portion or covering may be selected to provide appropriate properties for the intended application. For example, the covering may have a sufficient thickness to provide mechanical strength and minimize the risk of the covering being pierced or split, and the thickness may be selected to provide a selected degree of deformation; a thinner coating may provide for less deformation and a thicker coating may result in a ball that may undergo a greater degree of deformation. In other examples the ball may be of unitary construction and comprise a single material. The ball may be solid or may comprise voids or other open volumes. Materials suitable for forming a relatively rigid inner portion include chrome steel, stainless steel, unhardened carbon steel, tungsten carbide, brass, glass, and ceramics such as alumina oxide ($Al_2O_3$), silicon nitride ($Si_3N_4$) and zirconium oxide ($ZrO_2$). Materials suitable for forming a deformable outer portion, or the entire ball, include nylon, polyoxymethylene (POM) or acetal such as sold under the Delrin trademark, polypropylene, polyamide-imide (PAI) such as sold under the Torlon trademark, polytetrafluoroethylene (PTFE) such as sold under the Teflon trademark, and nitrile rubber.

At least one of the ball and the seat may be subject to at least one of elastic and plastic deformation as the ball engages the seat. The deformation may facilitate an increase in the surface area contact between the ball and the seat and the spring force generated by any elastic deformation may serve to increase or at least maintain a contact force between abutting surfaces.

The ball may comprise a material which deforms on engagement with the seat but is capable of recovering to an original form or is self-healing. For example, the ball may be deformed on being translated through or into grips or teeth but may then recover where not immediately restrained to assume or follow the form of the grips or teeth to increase the degree of engagement with the seat.

The ball may comprise a swellable material, for example a material which swells with exposure to downhole fluids such as oil, water, or brine, or which swells on exposure to other downhole conditions, such as downhole temperatures. The swellable material may comprise an outer portion of the ball.

The ball may travel to the seat, for example, from a surface location, solely under the influence of gravity, or fluid may be pumped behind the ball.

The seat may be configured to be secured in a downhole tubular. The seat may be configured to be translatable in a tubular, for example the seat may form part of a piston arrangement and may be translated by differential pressure when the ball is engaged with the seat.

The ball may be spherical or may have a non-spherical form. The ball may be incorporated in a dart or provided in combination with other elements, such as wipers, lock rings and seals.

The apparatus may be provided in combination with a tool, such as a bypass or circulation tool. For example, the apparatus may be mounted in a tubular forming part of a tubing string. In the first configuration, with the ball and seat spaced apart, fluid may be pumped through the seat. In the second configuration, with the ball and the seat in sealing engagement, fluid flow through the seat is prevented and a pressure differential may be created across the ball. Elevated pressure above the ball may be utilized to activate or actuate tools or devices. For example, an elevated pressure may be utilized to open a burst disc or other fluid-pressure responsive valve. As the ball is retained by the seat, the ball may remain in sealing contact with the seat in the absence of a pressure differential acting in the first axial direction and also if the assembly experiences a reverse pressure differential acting in the second axial direction.

According to a third aspect of the disclosure there is provided downhole sealing apparatus comprising a ball and a downhole seat, at least one of the ball and the seat being deformable, the ball having a diameter and being translatable downhole towards the seat, the seat comprising an upstream restriction of a diameter smaller than the diameter of the ball and a downstream restriction of a diameter smaller than the diameter of the upstream restriction, the ball and the seat having an open first configuration in which the ball and seat are spaced apart and a sealing second configuration in which the ball is retained between the upstream restriction and the downstream restriction, the arrangement being such that the ball is translatable through the upstream restriction on application of a differential pressure acting in a first axial direction, and wherein the seat comprises a first sealing portion for providing a sealing contact with the retained ball when the ball is subject to differential pressure acting in the first axial direction and the seat further comprises a second sealing portion for providing a sealing contact with the retained ball when the ball is subject to differential pressure acting in an opposite second axial direction.

These and other aspects of the disclosure may be combined or provided individually. The various features described above, and as described in the appended claims, may combined with the different aspects of the disclosure, and may also have utility when provided independently of these aspects.

BRIEF DESCRIPTION OF THE DRAWINGS

These and other aspects of the disclosure will now be described, by way of example only, with reference to the accompanying drawings, in which.

DETAILED DESCRIPTION

Figure 1:
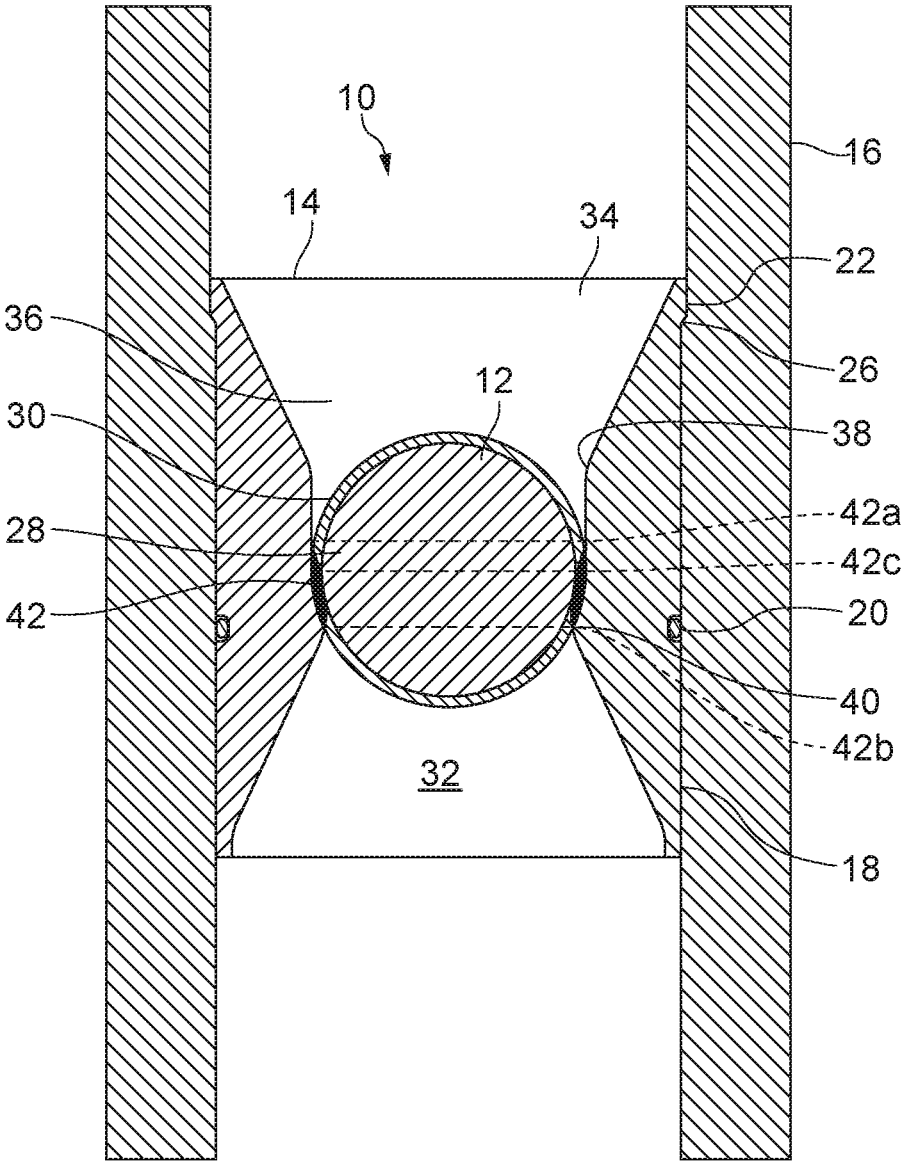
FIG. 1 is a schematic of downhole sealing apparatus comprising a ball and a downhole seat in accordance with a first example of the disclosure.
Figure 1A:
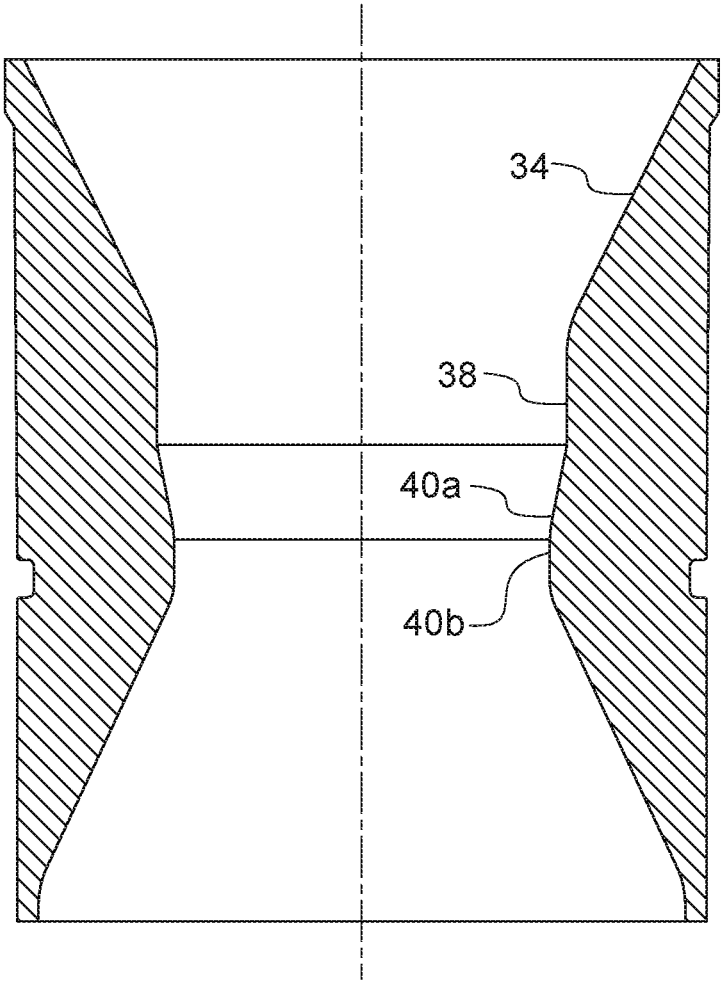
FIG. 1A is an enlarged sectional view of the seat of FIG. 1.

Reference is first made to FIG. 1 of the drawings, a schematic of downhole sealing apparatus 10 comprising a ball 12 and a downhole seat 14 in accordance with a first example of the disclosure, and also to FIG. 1A of the drawings, a schematic of the seat 14 of FIG. 1. The seat 14 is located within a downhole tubular 16, such as casing, liner or drill pipe and has a cylindrical outer surface 18 slightly smaller than the inner diameter of the tubular 16. In this example the seat includes an external seal 20 for engaging the tubular 16 and an upper lip 22 which engages a landing/locating shoulder 26 provided on the tubular 16.

FIG. 1 illustrates the apparatus 10 in a closed second configuration, with the ball 12 locked in sealing engagement with the seat 14. In an open first configuration, the ball 12 is spaced from the seat 14, and fluid may flow through the seat 14. The apparatus 10 will likely be initially provided in the open first configuration, with the seat 14 mounted in the tubular 16. The ball 12 may be stored on surface, for example on a surface rig, ready for deployment when it is desired to reconfigure the apparatus 10 to the closed second configuration and seal the tubular 16.

The ball 12 comprises a core 28 of a rigid material, such as a metal, and an outer covering 30 of a deformable material, such as plastics or polymeric material.

The seat 14 is formed from a rigid material, such as a metal, for example steel, and defines an axial through passage 32. The passage 32 includes an inlet portion 34 having a diameter which reduces from a maximum diameter only slightly smaller than the inner diameter of the tubular 16 to a central portion 36 having an entry portion 38 with a diameter marginally smaller than the diameter of the ball 12 and a sealing portion 40 which tapers to a no-go having an inner diameter smaller that the outer diameter of the ball core 28.

When the ball 12 is dropped or pumped down the tubular 16 the ball 12 will pass into the inlet portion 34 and then into the entry portion 38. As the ball 12 is translated into the entry portion 38 the outer surface of the ball 12 contacts the inner surface of the seat 14 and the passage 32 is sealed, or at least substantially occluded, allowing the operator to activate a surface pump and create a differential pressure across the ball 12 in a first axial direction, and urge the ball 12 further into the seat 14; in practice the momentum of the column of fluid following the ball 12 will likely be sufficient to move the ball 12 through the entry portion 38. Translation of the ball 12 further into the seat 14 beyond the entry portion 38 and into the sealing portion 40 results in deformation of a portion 42 of the outer covering 30. The form of the deformed portion 42 will depend on a number of elements, such as the relative dimensions of the ball 12 and the seat 14, the seat geometry, and the properties and thickness of the covering 30. In this example the portion 42 is bounded by "lines of latitude" 42*a*, 42*b*, which extend around the ball above and below the "equator" 42*c*. A band of maximum deformation is located between the equator 42*c* and the lower line of latitude 42*b*. The ball 12 will advance through the seat 14 and into the sealing portion taper 40*a* until the ball 12 encounters the sealing portion no-go 40*b* and the apparatus 10 is fully set; as the rigid core 28 is incompressible, the ball 12 cannot pass beyond the sealing portion no-go 40*b*.

The profile of the seat sealing portion 40 coupled with the deformation of the ball outer covering 30 generates a significant contact area between the ball 12 and the wall of the passage 32 and assists in the creation of an effective seal between the ball 12 and the seat 14. Further, to subsequently displace the ball 12 upwards and out of the passage 32 a significant force, such as a significant reverse differential pressure in a second/uphole axial direction, would be required to overcome the static friction and other retaining forces acting between the engaging surfaces of the ball 12 and the passage 32. The fully set sealing apparatus 10 may thus hold a differential pressure from both downhole and uphole directions.

In one example, for use with 5-inch (127 mm) drill pipe 16, and for use with a ball 12 having an outside diameter of 1.9 inches (48.26 mm), the seat 14 has a minimum internal diameter of 1.730 inches (43.942 mm). The inlet portion 34 features a taper of 25°, leading to a 0.519 inches (13.1826 mm) long cylindrical entry portion 38 with an inner diameter of 1.890 inches (48.006 mm), followed by a sealing portion taper 40*a* which is 0.445 inches (11.303 mm) long and has an inward taper of 10°. The tapering portion 40*a* terminates at a cylindrical no-go 40*b* which is 0.257 (6.5278 mm) inches long and has an inner diameter of 1.730 inches (43.942 mm). The corresponding ball 12 has an outside diameter of 1.9 inches (48.26 mm), having a rigid core 28 with an outside diameter of 1.75 inches (44.45 mm); the deformable covering 30 has a thickness of 0,075 inches (1.905 mm). In this example the covering/coating 30 is formed of hydrogenated nitrile butadiene rubber (HNBR) with a hardness of 80/90 durometer. An HNBR covering 30 with a thickness of 0.075 inches (1.905 mm) is sufficiently robust to maintain the covering integrity and withstand the applied pressures and deformation experienced on engaging the seat 14. Further, the relatively thin covering 30 also prevents excessive deformation of the ball 12 and generates an appropriate retaining force when fully engaged with the seat 14.

The ball 12 will thus advance into the seat 14 but cannot pass through the no-go 40*b*, given that the outside diameter of the rigid ball core 28 is larger than the inside diameter of the no-go 40*b*. The skilled person will appreciate that the compressed portion of the covering 42 will retain a thickness such that the core 28 will only advance to contact the no-go 40*b* in the event of the covering 30 being damaged and displaced from the core 28; in testing with a ball 12 as described, the covering 30 experienced up to 60% deformation, that is the thickness of some portions of the covering 30 following setting were 40% of the undeformed thickness. Typically, there will be contact between the outer surface of the covering 30 and the tapering portion 40*a* and also contact between the covering 30 and at least an initial area of the no-go 40*b*. The elasticity of the deformed volume of the covering 42 generates a recovery/spring force acting between the ball 12 and the seat 14, and the shallow taper 40*a* ensures that this force is effective to retain the ball 12 in the seat 14 and does not push the ball 12 out of the seat 14.

In testing with the ball 12 and seat 14 as described above, a pressure of less than 50 psi (0.345 MPa) seats and initially seals the ball in the seat and a pressure of up to 5000 psi (34.47 MPa) generated above the ball 12 set the apparatus 10 and locked the ball 12 in the seat 14. The apparatus 10 was then subject to a reverse pressure, tending the push the ball 12 back out of the seat 14. The ball 12 remained in sealing contact with the seat 14 and required a reverse pressure in excess of 450 psi (3.1 MPa) to dislodge the ball 12 from the seat 14.

Figure 2:
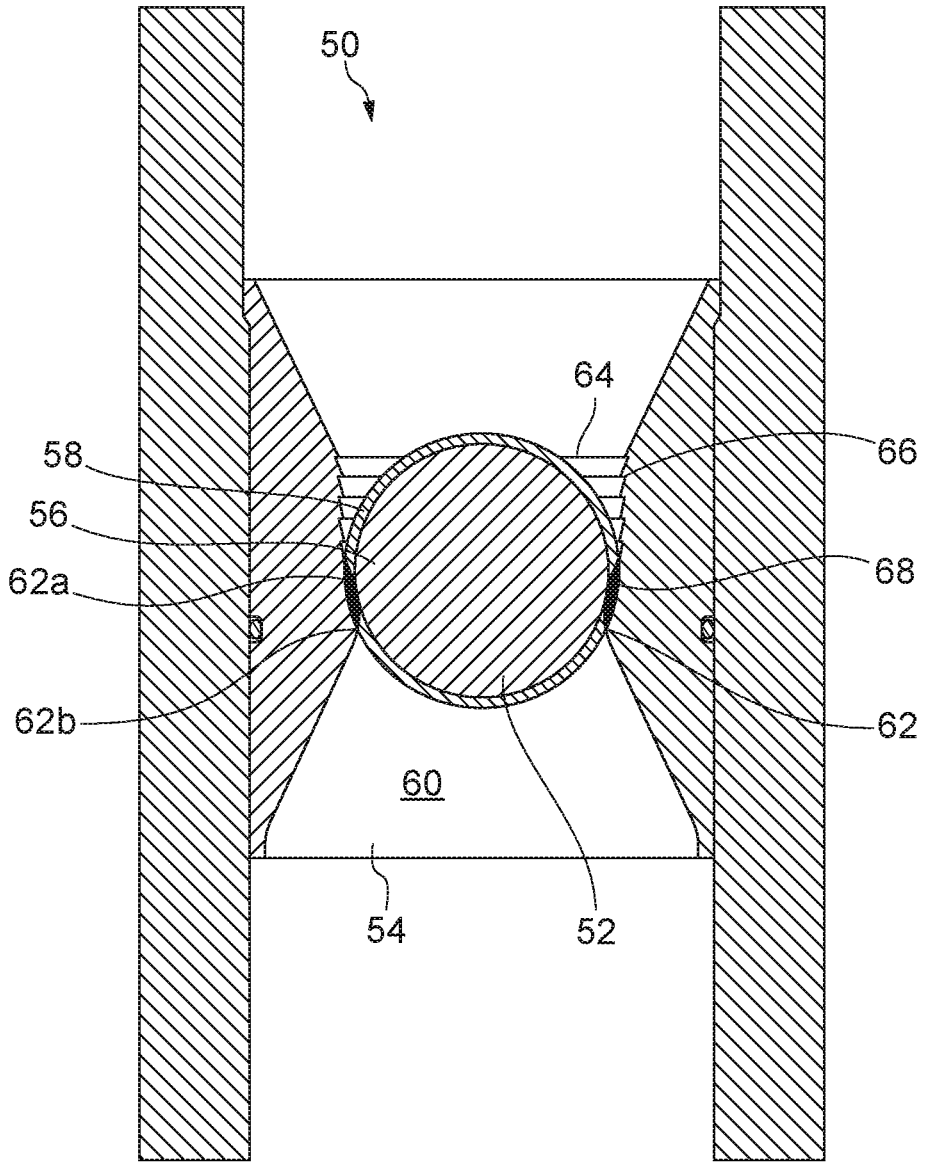
FIGS. 2 and 3 are schematics of downhole sealing apparatus comprising a ball and a downhole seat in accordance with second and third examples of the disclosure.

Reference is now made to FIG. 2 of the drawings, a schematic of downhole sealing apparatus 50 comprising a ball 52 and a downhole seat 54 in accordance with a second example of the disclosure. The ball 52 is similar to the ball 12 described above, having a rigid core 56 and a deformable outer covering 58.

The seat 54 shares a number of features with the seat 14 as described above and has an axial through passage 60 which narrows to a sealing portion 62 including a tapering portion 62*a* and a no-go portion 62*b*. However, above the sealing portion 62, the surface of the passage is provided with a grapple arrangement 64 comprising multiple teeth 66 having a sharp buttress thread-like form. The crests of the teeth 66 describe an inner diameter smaller than the outer diameter of the ball 52. Thus, when the ball 52 is pushed into the seat 54 the crests of the teeth 66 create a secondary seal with the ball 52 but also bite into and deform the ball covering 58, and thus further resist removal of the ball 52 from the seat 54. As with the first example, the radial compression and deformation of a volume of the covering 68 creates a primary seal with the seat sealing portion 62.

The covering 58 comprises a material that deforms as the ball 52 is compressed into the seat 54 and passes through and into the grapple arrangement 64, but the material will then recover and seek to retain the original form of the covering 58. This will result in the covering extending into the cavities between the distal teeth 66 and further securing the ball 52 in the seat 54. The engagement between the covering 58 and the teeth 66 further provides an additional or secondary seal in addition to the primary seal provided at the sealing portion 62.

Figure 3:
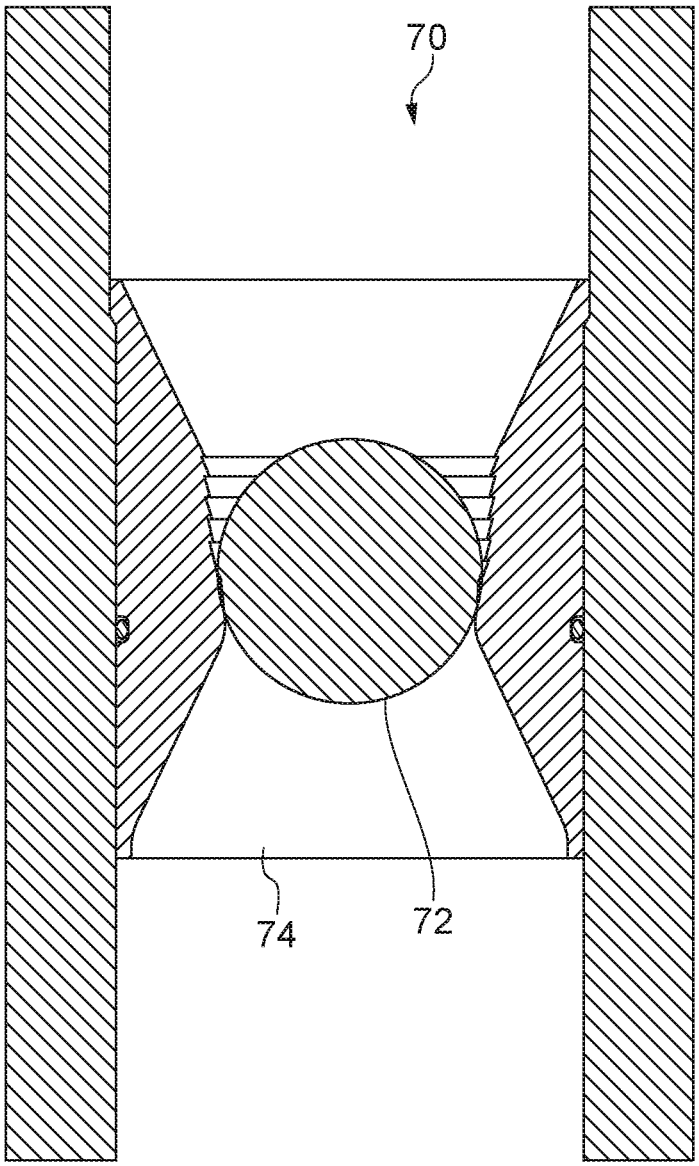

Reference is now made to FIG. 3 of the drawings, a schematic of downhole sealing apparatus 70 comprising a ball 72 and a downhole seat 74 in accordance with a third example of the disclosure. The apparatus 70 is similar to the apparatus 50 described above but features a ball 72 of unitary construction formed of a single material which may be subject to a limited degree of deformation. In such an example the material used to form the ball 72 may be harder than the materials selected to form the covering or coating of a ball with a rigid core, to ensure that the ball 72 is not deformed by operating pressures to an extent that would allow the ball 72 to be pushed through the seat 74.

Figure 4:
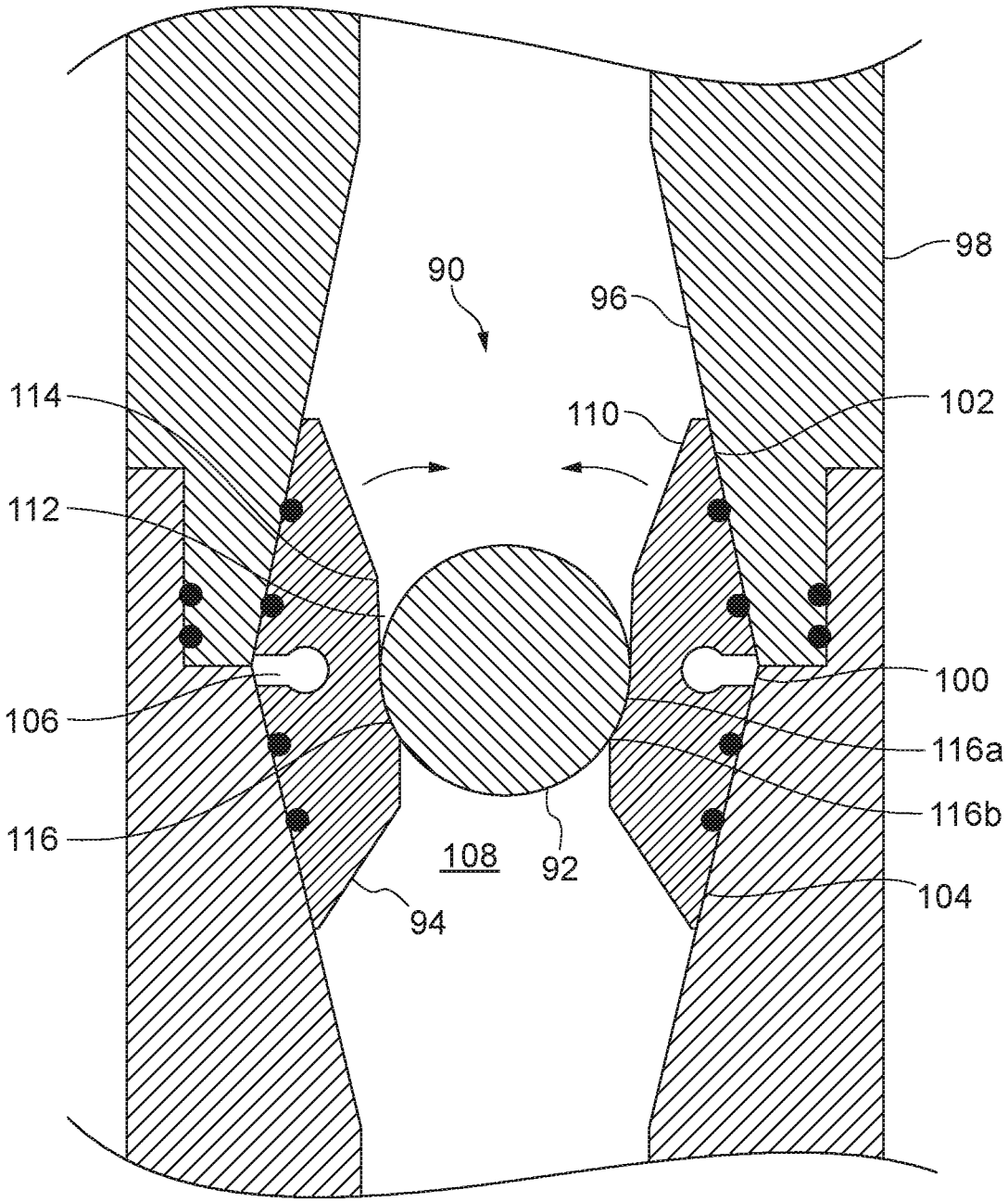
FIG. 4 is a schematic of downhole sealing apparatus comprising a ball and a downhole seat in accordance with a fourth example of the disclosure.

Reference is now made to FIG. 4 of the drawings, a schematic of downhole sealing apparatus 90 comprising a ball 92 and a deformable downhole seat 94 in accordance with a fourth example of the disclosure. The apparatus 90 is shown located in a profiled recess 96 formed in the through bore defined by a tubular 98, the recess 96 having a larger diameter mid-portion 100 and tapering upper and lower end portions 102, 104.

The ball 92 may be similar to the balls described in the previous examples, or in this example may comprise a relatively rigid material that does not undergo significant deformation. The seat 94 of this example has an outer form or profile to match the recess 96, similar to two truncated cones, and defines an external keyhole-form circumferential slot 106 around a central portion. The seat 94 is formed from a substantially rigid material, such as a metal, for example steel, but the provision of the slot 106 provides for a degree of flexibility and deformation of the seat 94, as described below.

The seat 94 defines an axial through passage 108 including an inlet portion 110 having a diameter which reduces from a maximum diameter only slightly smaller than the inner diameter of the tubular 98 to a central portion 112 having an entry portion 114 with a diameter similar to the diameter of the ball 92 and a no-go/sealing portion 116 defining a shallow taper 116*a* and a minimum diameter no-go 116*b* having an inner diameter smaller than the ball 92.

On the ball 92 landing in the seat 94, the occlusion of the passage 108 and creation of an initial seal between the ball 92 and the entry portion 114 and subsequently between the ball 92 and the sealing portion 116 allows a differential pressure to be created across the ball 92 and seat 94 in a first axial direction. Once the ball 92 has landed in the sealing portion 116 and the ball 92 cannot travel any further into the seat 94, an elevated pressure differential will translate both the ball 92 and seat 94 downwards in the recess 96, and further into the tapering lower end portion 104. The resulting radial compression forces on the seat 94, and the corresponding deformation of the seat 94, causes the ball 92 to be more tightly engaged by the seat 94, and the provision of the slot 106 facilitates radial inward rotation/deformation of the portion of the seat 94 above the slot 106; the entry portion 114 is partially wrapped around and clamps an upper portion of the ball 92. The decrease in the inner diameter of the entry portion 114 to a diameter less than the diameter of the ball 92 effectively creates a second no-go and prevents subsequent upward translation of the ball 92 relative to the seat 94.

The shallow taper in the profiled recess end portion 104 is such that the seat 94 is locked in the lower portion of the recess 96. The corresponding deformation of the seat 94 locks the ball 92 within the seat 94. The ball 92 and seat 94 thus provide a bidirectional seal.

Figure 5:
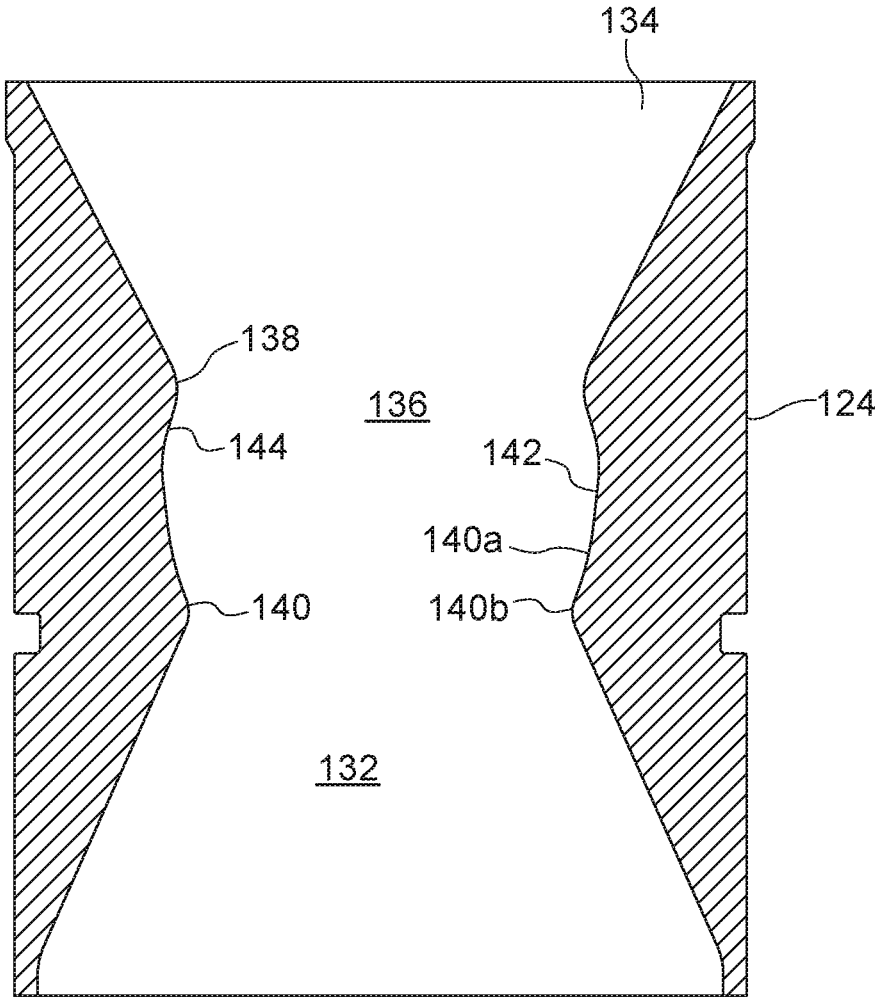
FIGS. 5, 6 and 7 are schematics of downhole sealing apparatus comprising a ball and a downhole seat in accordance with a fifth example of the disclosure.
Figure 6:
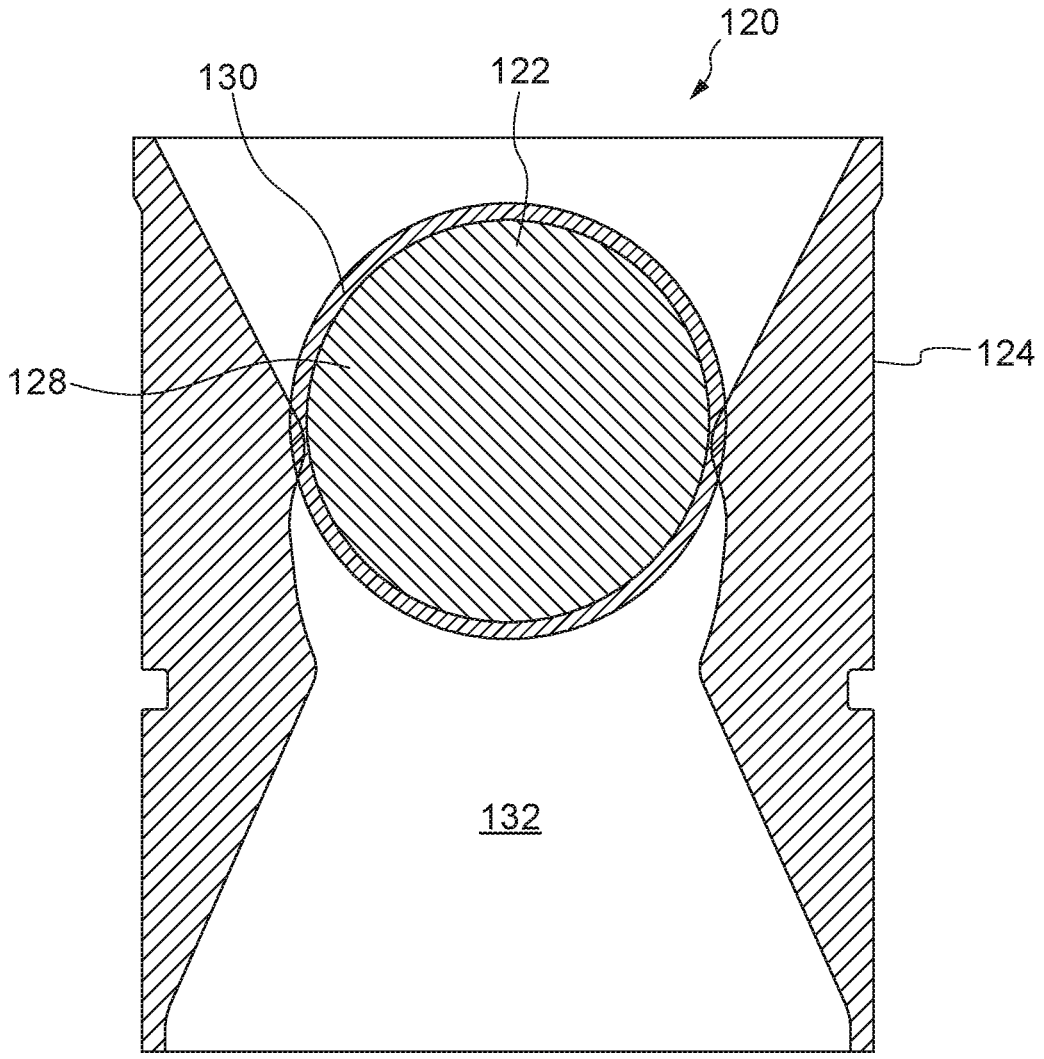
Figure 7:
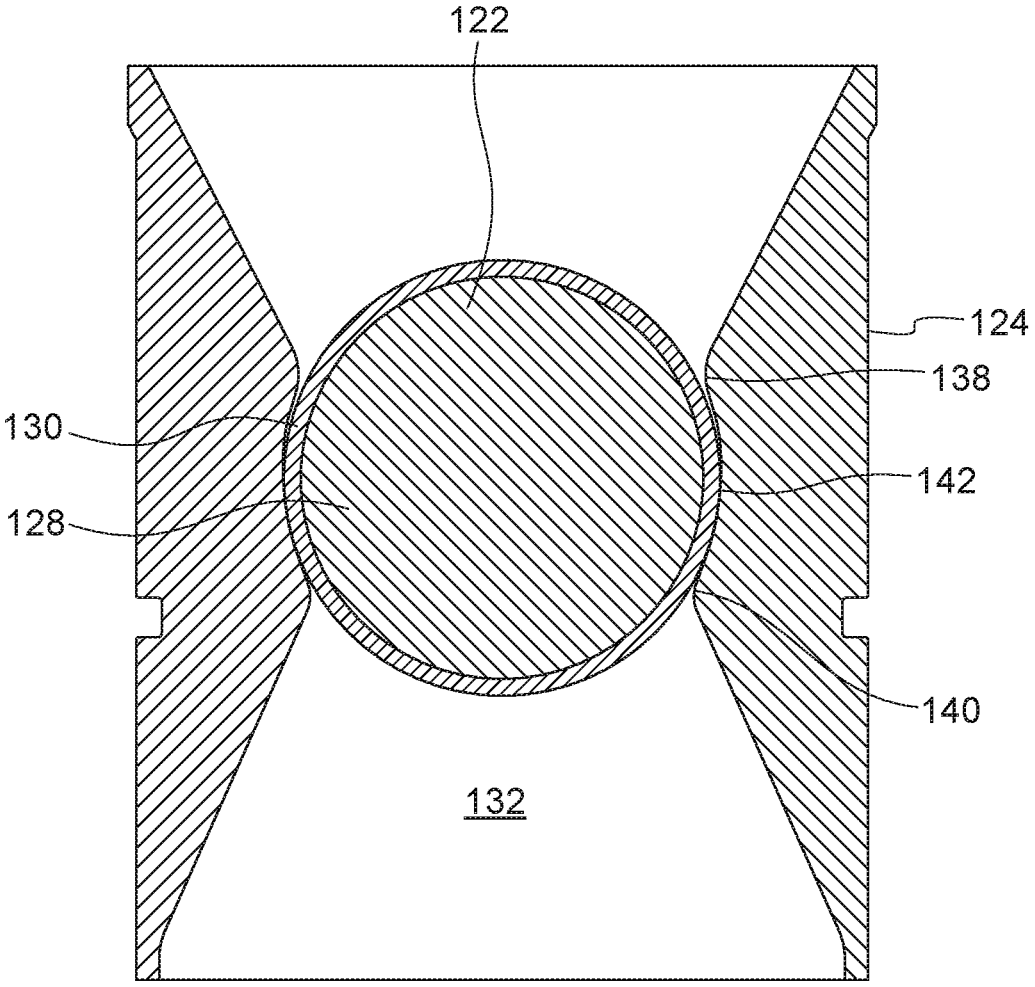

Reference is next made to FIGS. 5, 6 and 7 of the drawings, schematics of downhole sealing apparatus 120 comprising a ball 122 and a downhole seat 124 in accordance with a fifth example of the disclosure. FIG. 5 illustrates the apparatus 120 in an open first configuration, with the ball 122 (not shown in FIG. 5) spaced apart from the seat 124 such that fluid may flow through the seat 124. FIG. 7 illustrates the apparatus 120 in a closed second configuration, with the ball 122 locked in the seat 124.

The ball 122 is similar to balls described above, having a rigid core 128 provided with a deformable covering 130. The seat 124 defines an axial through passage 132 including an inlet portion 134 having a diameter which reduces from a maximum diameter only slightly smaller than the inner diameter of the tubular in which the seat 124 will be located to a central portion 136. The central portion 136 has an entry portion 138 with an inner diameter smaller than the diameter of the ball 122 but larger than the diameter of the ball core 128, and a first sealing portion 140 having a taper 140*a* that reduces to an inner diameter smaller than the outer diameter of the ball core 128 and thus which acts as a no-go 140*b* for the ball 122. Between the entry portion 138 and the sealing portion 140 is an enlarged diameter portion 142 with a maximum diameter similar to or only slightly smaller than the diameter of the ball 122. As will be described, an upper portion of the enlarged diameter portion defines a taper 144 which may act as a second sealing portion.

An operator may thus land the ball 122 in the seat 124 and by application of a predetermined elevated fluid pressure push the ball 122 through the entry portion 138; this requires deformation of the covering 130, as shown in FIG. 6. The ball 122 may only be translated as far as the first sealing portion 140 and provides a seal against differential pressure applied from above, in a first axial direction. The sealing portion taper 140*a* forms a swedge and provides a relatively large contact area between the ball 122 and the seat 124; on experiencing an elevated differential pressure the ball 122 is pushed down in the seat 124 and a portion of the covering 130 is deformed by engagement with the taper 140*a*.

If the apparatus 120 experiences a significant reverse or uphole differential pressure the ball 122 may be lifted from the sealing portion 140, but further translation will be prevented by the entry portion 138. Further, the taper 144 formed by the upper part of the enlarged diameter portion 142 below the entry portion 138 forms a swedge and the ball covering 130 is deformed as the ball 122 moves up into the taper 144 to provide a large contact area between the ball 122 and the seat 124. Of course, a very significant upwards pressure may be sufficient to overcome the associated friction and deform the ball 122 sufficiently to pass through the entry portion 138, but the ball materials and relative dimensions of the ball 122 and seat 124 may be selected such that the reverse pressures the apparatus 120 is expected to experience is unlikely to reach such magnitudes.

Figure 8:
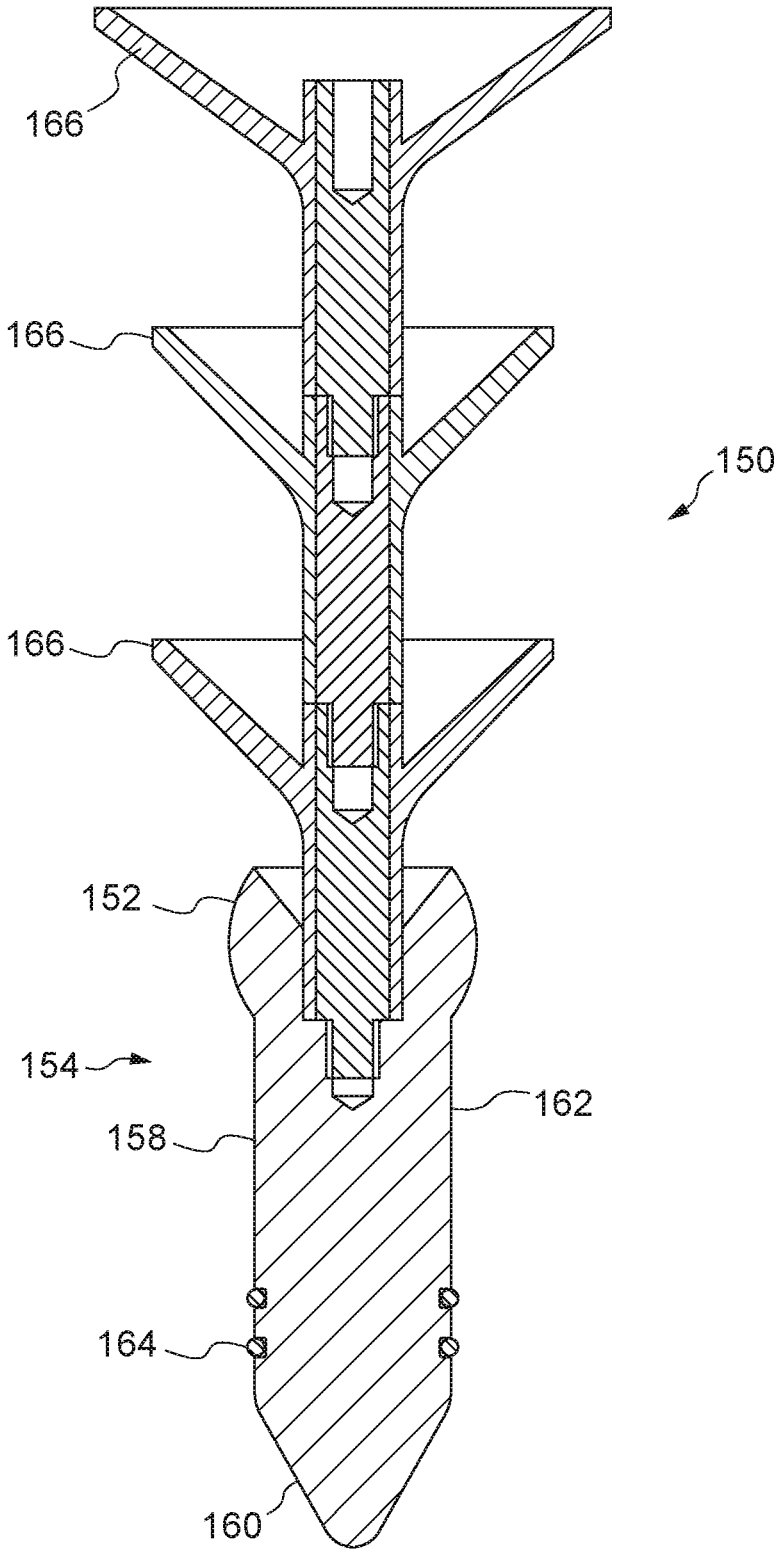
FIG. 8 is a schematic of a cement plug incorporating a ball of downhole sealing apparatus in accordance with a sixth example of the disclosure.
Figure 9:
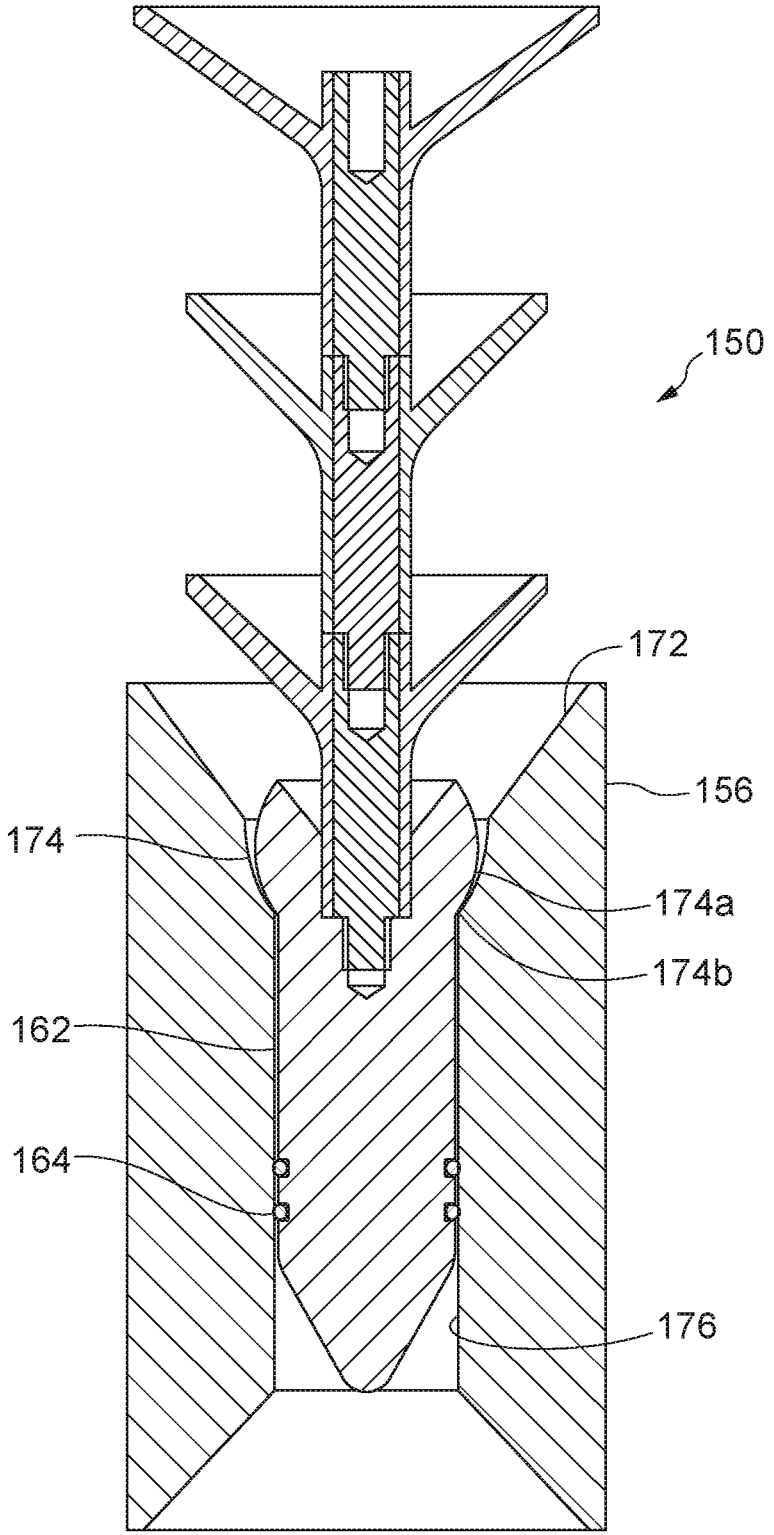
FIG. 9 is a schematic of the cement plug of FIG. 8 engaging a seat.

Reference is now made to FIG. 8 of the drawings, a schematic of a cement plug 150 incorporating a ball 152 of downhole sealing apparatus 154 in accordance with a sixth example of the disclosure, and to FIG. 9, a schematic of the cement plug 150 of FIG. 8 engaging a seat 156.

Unlike the examples described above, the ball 152 is not provided as a spherical body, but as a part-spherical form at an upper end of an elongate dart 158. The ball 152 and dart 158 may be formed of a unitary deformable material, or a deformable coating may be provided on the ball 152. The dart 158 also comprises a guide nose 160 and a cylindrical body portion 162 carrying a pair of circumferential seals 164. An upper end of the dart 158 is coupled to a set of three wiper cups 166.

In use, the cement plug 150 is pumped into a string to follow a volume of cement slurry into a bore hole. The wipers 166 clean the wall of the string as the plug 150 travels downhole. A cement float or float collar is provided at the distal end of the string and includes a seat 156 (FIG. 9) to receive the plug 150. As with the examples described above the seat 156 includes an entry portion 172 which leads to a sealing portion 174 including a taper 174*a* and a no-go 174*b*. The no-go 174*b* is provided at an upper end of a cylindrical polished bore 176 which receives the dart body 162 and engages with the seals 164.

The ball 152 is translated into the seat 156 and is deformed and retained in the seat by engagement with the taper 174*a*. The plug 150 will thus remain in the seat 156 even when exposed to a reverse differential pressure, such as may be created by "u-tubing" of a column of cement in a surrounding annulus. A typical cement shoe will include two check valves intended to prevent reverse flow, but it is not uncommon for these valves to fail. The apparatus 154 thus provides an operator with additional assurance.

In other arrangements a latch arrangement may be provided to secure the dart body 162 in the bore 176. For example, a split ratch ring with a grapple grip may be mounted on the body 162, or a lock or latch split ring could be provided in the wall of the bore 176.

Figure 10:
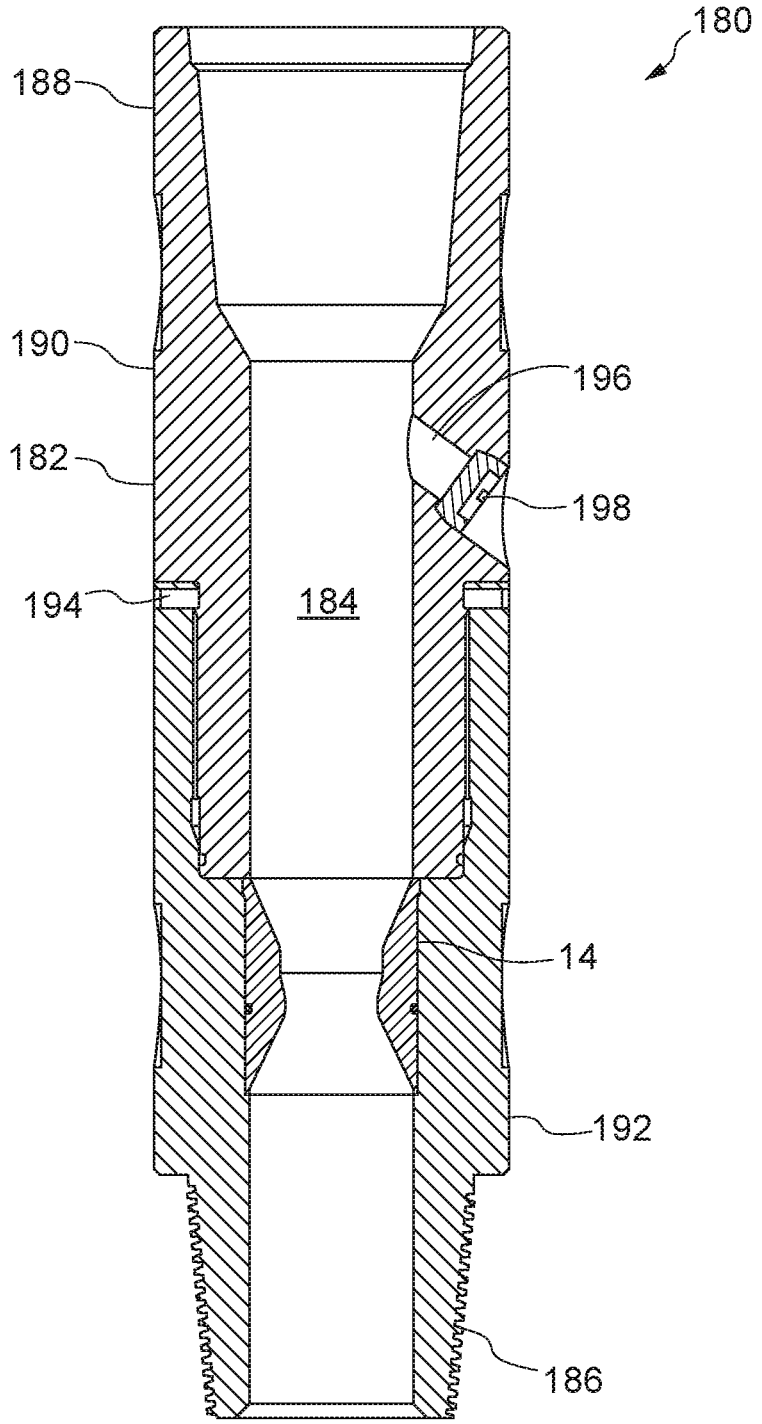
FIG. 10 is a schematic of a circulation sub incorporating a seat of downhole apparatus in accordance with an example of the disclosure.

Reference is now made to FIG. 10 of the drawings, a schematic of a circulation sub 180 incorporating a seat of downhole apparatus in accordance with an example of the disclosure, such as the seat 14 of FIG. 1.

The sub 180 comprises a cylindrical body 182 having a through bore 184 and threaded ends for connecting to adjacent drill pipe joints, in particular a lower pin connection 186 and an upper box connection 188. The sub 180 may thus be incorporated in a drill pipe string and the like. The body 182 comprises an upper part 190 and a lower part 192 which are threaded together and secured by anti-back-off pins 194. The seat 14 is secured in the bore 184 between the parts 190, 192 and is restrained against both downwards and upwards movement relative to the body 182. A circulation port 196 is provided in the wall of the upper body part 190 to provide fluid communication between the bore 184 and an annulus surrounding the sub 180 and associated string. The port 196 is initially closed by a burst disc 198.

In use, with the sub 180 in the initial configuration with the port 196 closed, fluid may be circulated through the string in a conventional manner, for example from surface pumps, down through the string and a bottom hole assemble (BHA), to exit the distal end of the string through jetting nozzles in a drill bit, and then circulate back to the surface through the annulus between the bore wall and the string. However, if a situation arises where the operator wishes to pass fluid directly into the annulus, without the fluid passing through the bit or other elements of the BHA, a ball 12 (FIG. 1) is dropped or pumped through the string to land in the seat 14. As described above, the ball 12 engages and forms a seal with the seat 14 and is effectively locked into the seat 14.

Pressure may then be built up in the bore 184 above the ball 12, sufficient to rupture the disc 198 and allow fluid to flow from the bore 184 directly into the surrounding annulus.

The skilled person will recognize that the sub 180 may be provided at any suitable location in a string, and indeed multiple subs may be provided in a single string, with distal subs configured to be activated by smaller diameter balls that may pass freely through proximal subs having seats configured to engage larger diameter balls.

The skilled person will further recognize that downhole apparatus of the present disclosure will have utility in a wide range of applications. For example, a seat may be provided in or in combination with a cement shoe for use in cementing a casing in a bore, allowing a ball to be dropped or pumped into a shoe following delivery of a volume of cement slurry down a cementing string, through the shoe, and into an annulus surrounding the casing, the ball creating a bidirectional seal in the shoe, and allowing fluid pressure-related operations to be carried out in the cementing string and casing string. In one operation, a casing annulus filled with cement slurry may be isolated from the cementing string by pumping a ball into a seat in the shoe, and the inside of the casing may then be displaced with well cleaning fluids and or displaced to completion brine. The ball may be a spherical ball as described herein, or incorporated in a dart as described with reference to FIGS. 8 and 9. For example, as described in our WO2021/028689, WO2019/025798 and WO2019/025799, the disclosures of which are incorporated herein in their entirety, a ball may be landed in a flow port provided in a cement shoe, or a coupling or tubular above the shoe, to ensure that cement slurry is retained in an annulus and to permit opening of valves in an inner string, followed by circulation of cleaning or conditioning fluid in an inner annulus to, for example, accelerate the setting of the cement in the surrounding outer annulus. If the flow port is provided with a seat as described herein and receives and engages a ball as described herein, the operator can be assured that there is minimal risk of reverse flow of cement slurry from the outer annulus.

For such a cementing application, multiple seats may be provided to allow, for example, opening of multiple fluid circulation ports in a desired sequence, with a distal circulation port being opened prior to isolating that port and then opening a proximal circulation port.

The skilled person will appreciate that the above examples provide apparatus in which a ball may be utilized to provide a bidirectional seal. The ball does not require a differential pressure to be retained on the seat and will indeed hold a reverse differential pressure. Examples of the apparatus will typically be set using a differential pressure of 2500 to 5500 psi (17.24 to 37.92 MPa) and may be configured to hold such pressures, with a suitable safety margin. The reverse pressure the apparatus will be required to hold may vary depending on the application. For example, in a cementing application a reverse differential pressure of approximately 400 psi (2.76 MPa) represents the difference in hydrostatic pressures with cement slurry in an annulus and a light mud inside the casing; if the float check-valves are leaking the apparatus will experience such a pressure. For such an application the set apparatus may be configured to hold a reverse pressure of at least 450 or 500 psi (3.10 to 3.45 MPa).

The skilled person will appreciate that the apparatus featured in the above description and the attached drawings are merely exemplary of the present disclosure, and that various modifications and improvements may be made to these examples without departing from the scope of the disclosure.

The illustrated seat arrangements include shallow tapers which may act as taper locks to assist in sealing and securing the ball in the seat. The example described with reference to FIG. 1 features a 10° taper, but in other examples the taper could be less, for example an inward taper of 5°, or more, for example an inward taper of 15°. In other examples the no-go portion of the seat may not be integrated with the sealing taper and may simply be provided by a 90° hard shoulder, or by providing a steeper taper, for example a 45° taper.

The balls as described above may comprise a swellable material, such as a material that tends to increase in volume over time on exposure to downhole fluids. Such balls would be engaged in a respective seat relatively quickly and thus would experience little or no expansion as the ball was translated from surface and located in the seat. However, over a period of time the balls, for example a swellable ball covering, would tend to expand. This would lead to a larger area of the ball engaging the seat and those areas of the ball that were already in contact with the seat and thus restrained by the seat would experience a higher contact force between the opposing surfaces as the material attempted to expand but was restrained by the surface of the seat.

The skilled person will appreciate that tubular items such as the seats described herein may be secured and sealed in a tubular by a number of different arrangements available to the skilled person. Given that the ball and seat combination is intended to resist both downwards and upwards forces as generated by differential pressure acting in both axial directions it will be understood that the seat is secured to prevent or limit both downwards and upwards movement relative to the surrounding tubular, such as in the seat-mounting arrangement illustrated in FIG. 10.

The invention claimed is:

1. A downhole sealing apparatus comprising a downhole tubular, a ball including a deformable outer portion and a rigid inner portion, and a rigid non-deformable downhole seat mounted in the downhole tubular, the ball being translatable downhole towards the seat, the apparatus having an open first configuration and a sealing second configuration, in the open first configuration the ball and the seat being spaced apart such that fluid may flow through the seat, the seat being configured to permit the ball to be translated in a first axial direction into a sealing location within the seat, whereby in the sealing second configuration the ball is in the sealing location within the seat, and the ball and the seat are in sealing engagement, the outer portion of the ball being deformed to provide a ball-retaining contact between the deformed outer portion of the ball and the seat to maintain the sealing engagement in response to a differential pressure acting in the first axial direction and in response to a differential pressure acting in an opposite second axial direction.

2. The apparatus of claim 1, wherein the seat comprises a no-go for the ball preventing downhole translation of the ball beyond the seat.

3. The apparatus of claim 1, wherein the seat comprises at least one of a restriction, a taper, directional grips, or teeth.

4. The apparatus of claim 2, wherein the seat comprises at least one of a restriction, a taper, directional grips, or teeth.

5. The apparatus of claim 1, wherein the ball comprises a swellable material.

6. The apparatus of claim 1, wherein the ball is incorporated in a dart.

7. The apparatus of claim 1, wherein the seat is axially fixed to the downhole tubular.

8. The apparatus of claim 1, wherein in the sealing second configuration, the outer portion of the ball is elastically deformed.

9. The apparatus of claim 1, wherein in the sealing second configuration, the outer portion of the ball is plastically deformed.

10. The apparatus of claim 1, wherein the ball has an equator and, in the sealing second configuration, the ball-retaining contact between the deformed outer portion of the ball and the seat extends both uphole and downhole of the equator.

11. A downhole tool in combination with the apparatus of claim 1.

12. The tool of claim 11, comprising a pressure responsive valve above the seat.

13. A downhole sealing method comprising:

providing a downhole sealing apparatus comprising a downhole tubular, a ball including a deformable outer portion and a rigid inner portion, and a rigid non-deformable downhole seat mounted in the downhole tubular;

translating the ball downhole and into the downhole tubular to engage with the seat; and translating the ball in a first axial direction into the seat to a sealing location within the seat, and deforming the outer portion of the ball to create a ball-retaining contact between an outer surface of the deformed portion of the ball and an opposing inner surface of the seat, whereby the ball and the seat cooperate to provide a bidirectional seal by maintaining a sealing engagement in response to a first differential pressure acting in the first axial direction and in response to a second differential pressure acting in an opposite second axial direction.

14. The method of claim 13, further comprising:

engaging the ball with a no-go in the seat.

15. The method of claim 13, further comprising translating the ball into a taper provided in the seat.

16. The method of claim 13, further comprising elastically deforming the outer portion of the ball as the ball is translated into the seat.

17. The method of claim 13, further comprising:

mounting the seat in the downhole tubular with the ball and the seat spaced apart;

pumping fluid through the seat;

engaging the ball and with the seat, and pumping fluid and creating a pressure differential across the ball.

18. The method of claim 17, further comprising:

creating an elevated pressure above the ball to actuate a tool; and utilizing the elevated pressure to open a pressure-responsive valve.

19. The method of claim 13, further comprising plastically deforming the outer portion of the ball as the ball is translated into the seat.

20. The method of claim 13, wherein the ball has an equator, and wherein when the ball has been translated into the seat, the ball-retaining contact between the deformed outer portion of the ball and the seat extends both uphole and downhole of the equator.

* * * * *